United States Patent [19]

Grinder

[11] 4,129,237

[45] Dec. 12, 1978

[54] GOLFER'S AID

[76] Inventor: Charles E. Grinder, 9366 Schaefer Rd., Converse, Tex. 78109

[21] Appl. No.: 767,780

[22] Filed: Feb. 11, 1977

[51] Int. Cl.[2] ..... A45C 11/00; A63B 57/00

[52] U.S. Cl. ..... 224/5 C; 273/32 A

[58] Field of Search ..... 273/32 A, 32 B; 224/5 C, 26 B

[56] References Cited

U.S. PATENT DOCUMENTS

| | | | |
|---|---|---|---|
| 3,556,364 | 1/1971 | Maretka | 273/32 A X |
| 3,620,426 | 11/1971 | Hatch | 273/32 A X |
| 3,674,189 | 7/1972 | Walbeck | 224/5 C |

*Primary Examiner*—George J. Marlo
*Attorney, Agent, or Firm*—Willard J. Hodges, Jr.

[57] ABSTRACT

A combined holder for golf tees, divot repair tool and ball marker including a spring clip for attaching the holder to a shoe, belt, waist band, or pocket. The device is constructed from flexible plastic formed in a pouch arrangement having a central pocket containing a divot repair tool, two tee pockets placed on each side of the central pocket, a snap retained ball marker secured to the front surface of the pouch, and an elongated spring clip secured to the rear surface of the pouch permitting attaching to an item of golfing apparel.

5 Claims, 4 Drawing Figures

GOLFER'S AID

BACKGROUND OF THE INVENTION

1. Field of the Invention

The invention pertains to a golfer's aid comprising a convenient packet containing golf tees, a divot repair tool, and a ball marker. The spring clip projecting from the device permits attaching to a shoe or various other items of golfing apparel.

DESCRIPTION OF PRIOR ART

A wide variety of tee holders is well known to the prior art. The majority of these devices are designed to be attached to a belt by loops such as Ladue, 1,588,461. Other related inventions are Ward, Des. 165,253; Guiterman, 1,806,797; and Stephens and Grunert, 3,744,542.

SUMMARY OF THE INVENTION

A flexible plastic pouch-like holder for golf tees and a divot repair tool with a ball marker snap fastened to the exterior. A spring clip secured to the rear of the pouch permits securing the device to a golf shoe, a belt, or the edge of any golfing apparel. The pouch is constructed of a flexible plastic material in a configuration having three pockets; two for golf tees and one for a divot repair tool. The internal seams and central pocket are formed by heat sealing while the outer edge is preferably bound and stitched. The spring clip on the back of the pouch is plastic covered constructed integral with the central pocket of the pouch.

DESCRIPTION OF THE PREFERRED EMBODIMENT

Figure 1:
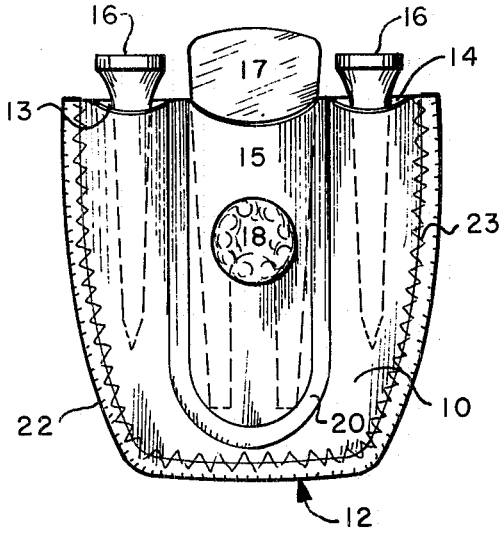
FIG. 1 is a front elevation view of the composite device.

For a detailed description of the construction and use of the device, reference is made to the drawings wherein identical reference characters are utilized throughout the various views and the following detailed description to refer to identical or equivalent components.

Figure 2:
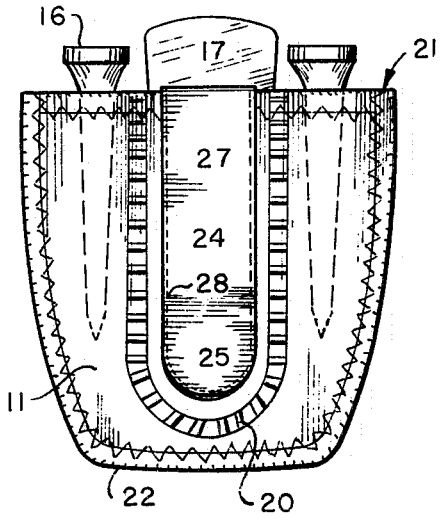
FIG. 2 is a rear elevation view of the composite device.
Figure 3:
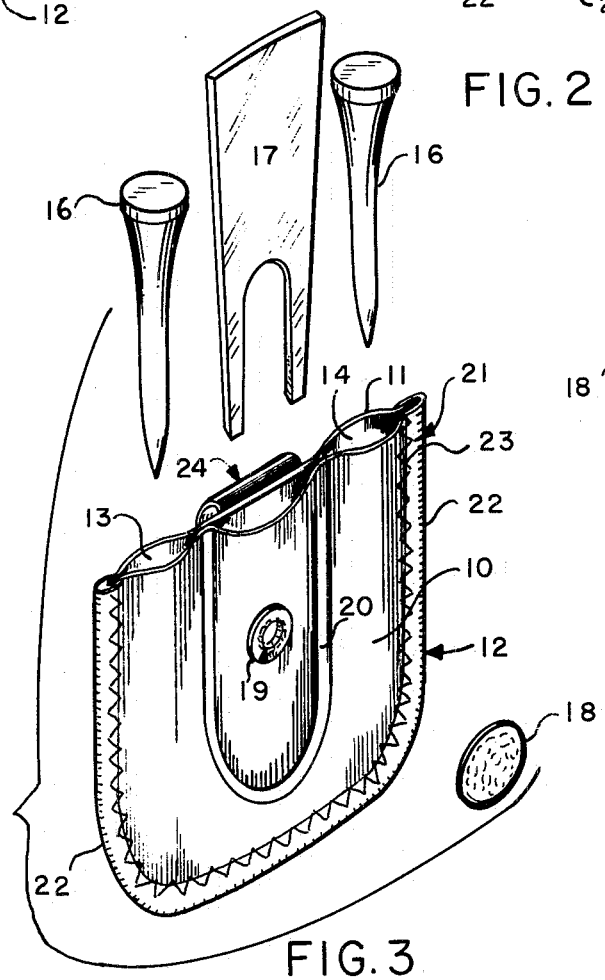
FIG. 3 is an exploded front elevation view of the device with the components removed from the pouch.

For the general arrangement of the various components reference is particularly made to FIGS. 1 and 2. The device is susceptible of construction employing a wide variety of fabrics and flexible plastic materials. The preferred embodiment was constructed using flexible sheets of polyvinyl chloride. A first sheet 10 and a second sheet 11 having the general configuration as illustrated in FIGS. 1 and 2 were secured together to form a pouch 12. The pouch 12 was constructed with a first tee pocket 13 adjacent one edge and a second tee pocket 14 adjacent the opposite edge of the pouch 12. In the center section of the pouch was constructed a central pocket 15. The exterior dimensions of the completed pouch 12 was approximately 2½ inches by 2½ inches. The tee pockets 13 and 14 were approxiamtely ½ inch wide while the central pocket 15 was ¾ inch wide. The length and configuration of the structure receives and retains two golf tees 16 which are normally approximately 2 inches in length in the tee pockets 13 and 14 while the divot repair tool 17 having a length of approximately 2½ inches fits into the central pocket 15 substantially as illustrated in FIGS. 1 and 2. A ball marker 18 is secured by a snap fastener 19 type means to the front outer surface of the pouch 12 substantially in the center of the central pocket 15. The female portion of the snap fastener 19 is secured to the first plastic sheet 12 whereas the male portion of the snap fastener is constructed as a part of ball marker 18. The general configuration of the portion of the marker snap fastener 19 securely attached to the pouch 12 is illustrated in FIG. 3. The preferred embodiment was constructed employing a heat sealed seam 20 surrounding the edge of the central pocket 15 forming the internal seam of first tee pocket 13 and second tee pocket 14 while defining the central pocket 15. The outer edge seam 21 is preferably constructed by stitching and binding thin vinyl folded over at the outer edge seam 21 to form the edge binding 22 and in the preferred embodiment a zig zag outer edge stitching 23 was employed. This method of construction of the outer edge seam 21 is flexible and durable and proved to be a satisfactory method of construction.

Figure 4:
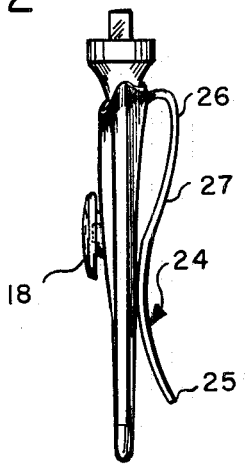
FIG. 4 is a side elevation view illustrating the contour of the spring clip.

For an illustration of the configuration of the arcuate spring clip 24 reference is particularly made to FIGS. 2 and 4. Spring clip 24 is approximately 2⅛ inches long having a flared tip 25 to facilitate the ease of attaching spring clip 24 and the pouch 12 to an item of golfing apparel. The central arch 26 of spring clip 24 is formed on the radius of approximately ¼ inch. This arch 26 with its resulting internal depth or opening of approximately ⅜ of an inch is a desirable configuration when securing spring clip 24 and pouch 12 to a golf shoe. Spring clip 24 in the preferred embodiment was constructed with a vinyl clip covering 27. This covering 27 was secured around spring clip 24 by means of clip edge seal 28 which was a heat seal.

Various methods of construction of the device might be employed with all of the seams formed by stitching or the seams might utilize a durable glue. Any flexible fabric could be employed or the pouch 12 might be constructed utilizing leather. The preferred embodiment constructed of soft, flexible sheets of polyvinyl chloride; however, has proved quite satisfactory.

Utilization of the device is rather self-evident and in use may be attached to a golf shoe, the edge of a pocket, the waist band of trousers, skirt or shorts; it might be clipped to a golf bag. The method and use of the device is not particularly pertinent to the invention; however, a structure having this high degree of flexibility is the inventive concept incorporated in the structure and combination of this invention.

What is desired to be claimed is all variations of the foregoing design and combination not departing from the scope of equivalents of the structure or various components as defined in the appended claims.

I claim:

1. A golfing aid comprising:

a. a pouch-like container having a first edge and a second edge, b. a first pocket formed in said pouch adjacent said first edge, c. a first golf tee inserted in said first pocket, d. a second pocket formed in said pouch adjacent said second edge, e. a second golf tee inserted in said second pocket, f. a central pocket constructed intermediate said first pocket and said second pocket, g. a divot repair tool inserted in said central pocket, h. a snap fastener attached to a first side of said central pocket for securing a ball marker to said central pocket, i. a spring clip secured to a second side of said central pocket, said clip having a configuration suitable for clipping to an item of golfer's apparel, and j. a flexible covering encasing said spring clip.

2. The invention of claim 1 further comprising edge stitching securing the said first edge and the said second edge of said pouch.

3. The invention of claim 1 further comprising a heat sealed seam intermediate said first pocket and said second pocket and said central pocket.

4. The invention of claim 1 further comprising edge binding covering said first edge and said second edge of said pouch.

5. The invention of claim 1 wherein said covering is a flexible, plastic secured to said spring clip by a clip edge seal.

* * * * *